United States Patent [19]

Roca-Nierga et al.

[11] Patent Number: 4,459,956

[45] Date of Patent: Jul. 17, 1984

[54] GOVERNOR FOR FUEL INJECTION PUMPS

[75] Inventors: Manuel Roca-Nierga, Barcelona, Spain; Italo Branchetti; Mauro Forapianti, both of Leghorn, Italy

[73] Assignee: SPICA S.p.A., Leghorn, Italy

[21] Appl. No.: 409,407

[22] Filed: Aug. 19, 1982

[30] Foreign Application Priority Data

Aug. 27, 1981 [DE] Fed. Rep. of Germany ..... 3133898

[51] Int. Cl.[3] ..... F02D 1/04

[52] U.S. Cl. ..... 123/373; 123/372; 123/374

[58] Field of Search ..... 123/373, 374, 366, 365, 123/367–372

[56] References Cited

U.S. PATENT DOCUMENTS

| | | | |
|---|---|---|---|
| 2,096,203 | 10/1937 | Schnurle et al. | 123/373 |
| 3,938,487 | 2/1976 | Peltret | 123/366 |
| 3,942,498 | 3/1976 | Eheim et al. | 123/373 |
| 3,973,542 | 8/1976 | Shum | 123/373 |
| 3,980,066 | 9/1976 | Hollins | 123/373 |
| 4,026,260 | 5/1977 | Kleimenhagen et al. | 123/365 |
| 4,082,073 | 4/1978 | Balogh | 123/373 |
| 4,095,574 | 6/1978 | Yoshino et al. | 123/373 |

FOREIGN PATENT DOCUMENTS

| | | | |
|---|---|---|---|
| 1426096 | 10/1968 | Fed. Rep. of Germany | 123/373 |
| 1276798 | 10/1960 | France | 123/373 |
| 432839 | 8/1935 | United Kingdom | 123/373 |

*Primary Examiner*—Ira S. Lazarus
*Assistant Examiner*—Magdalen Moy
*Attorney, Agent, or Firm*—Diller, Ramik & Wight

[57] ABSTRACT

A centrifugal governor for adjusting the fuel delivery to an internal combustion engine of the Diesel type is disclosed, wherein centrifugal masses slide along a tubular supporting member and act upon a sleeve, a spring and a slider to govern, through an eccentric-controlled adjustment lever, the rate of flow of the fuel injected into the engine, to reproduce, at will any desired law of variation of the fuel delivery according to the individual requirements of each particular engine.

11 Claims, 19 Drawing Figures

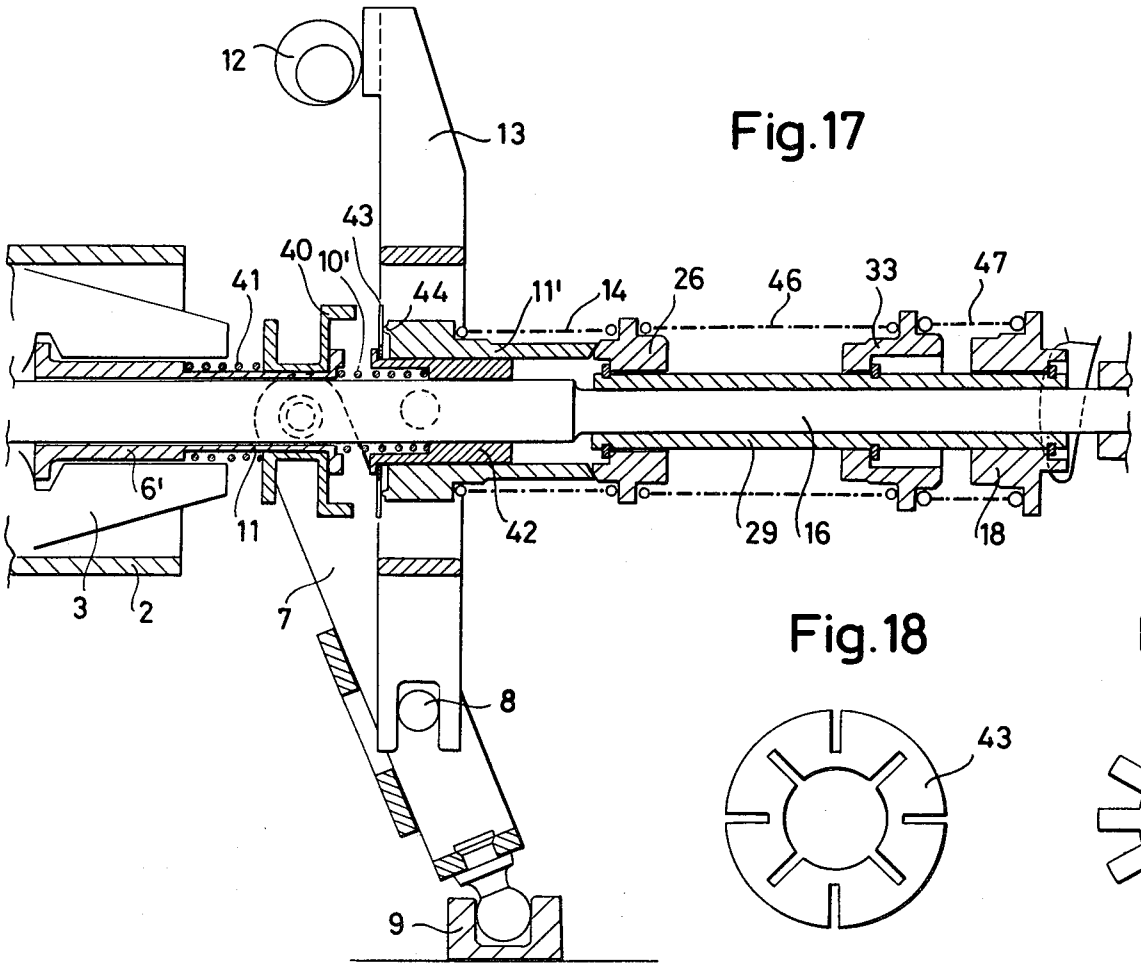
Fig.17
Fig.18
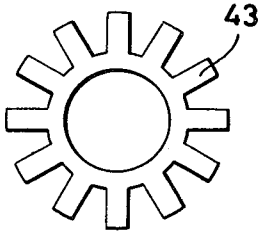
Fig.19

GOVERNOR FOR FUEL INJECTION PUMPS

In the field of the centrifugal governors for injection pumps of the so-called "in line" type, an approach is known which provides for mounting the resilient bias system of the rotary unit on a tubular member which is slidable on a guideway integral with said unit. This approach, however, offers considerable difficulties in the calibration of the system because the adjustment and stop elements (dish and nut) are screwably coupled to the slidable tube and do not lend themselves, consequently, to an easy and rapid automatic calibration of the system. Also the replacement of the resilient system or a calibration of it anew are difficult to perform because both these operations require overhauling the entire governor box.

The conventional unit aforesaid, in addition, has a poor functional versatility since the intermediate dishes provide a slidable mount on the tubular member without however providing for the cooperation with fixed abutments. This fact involves the consequence that intricate regulation laws cannot be executed, such as those which provide for the segmentation of the functional field as required, for example, on the injection systems intended for use in the present Diesel engines for motor cars.

Moreover, in the conventional governor aforementioned it is often possible to see the presence of lateral component forces on the resilient adjustment system originated by the inaccurate alignment between the guiding pin of the tubular member which supports the resilient biassing system and the tail portion of the camshaft to which the centrifugal thrust unit is keyed. Such a misalignment is made possible by the different ways in which the two elements involved are fastened. As a matter of fact, the guiding pin of the biassing resilient members is mounted on the governor lid, whereas the camshaft is centrally mounted on the injection pump casing.

Governors of this kind, for example, are described in the French Patents 1260052 and 1266916.

According to another conventional embodiment of a governor for injection pumps, a resilient biassing unit has been provided, mounted between a regulating lever and a control lever and composed of a number of compression springs and a number of dishes contained within two connecting parts upon which the ends of the spring which are the farthest from the lever are active.

Said resilient unit overcomes the difficulty of obtaining the intricate regulation laws required for use in motor cars but necessitates the presence of lateral guides for the dishes to keep the system aligned during operation. Such lateral guideways, on the other hand, are a source of considerably detrimental frictional forces impairing the operation of the governor. In such an embodiment it can be seen, moreover, that the entire weight of the resilient biassing unit is insisting upon the control and regulation levers connected thereto.

Another drawback affecting the conventional embodiment is the intricacy of the operations for dismantling the resilient unit from the governor assembly. As a matter of fact, to effect such an operation, it is required that the entire governor lid is overhauled, to which several control devices are connected.

Governors of this second type are described, for example, in the U.S. Pat. Nos. 3,942,498 and 3,945,360.

The principal object of the present invention is to redress the drawbacks of the conventional art by providing a governor equipped with a resilient biassing unit having the following properties:

(1) Easy automatized calibration, out of line, of the entire sub-assembly. This involves a considerable cost reduction in mass production.

(2) Maximum functional versatility to fulfil any requirements as to the regulation law.

(3) Rapidity of assembly and replacement in the regulating group to vary the functional characteristics or to correct calibration (4) Absence of frictional forces due to lateral component forces on the supporting tube or on the spring carrying dishes.

(5) Weight of the resilient sub-assembly which does not insist upon the regulation levers.

Said characteristics are obtained, according to the present invention, by using a biassing resilient group consisting of one or more compression springs in series and of a plurality of dishes which, cooperating, or not, with resilient stopping rings, are supported by a small tube slidable along the governor arbor. Inasmuch as said arbor is an extension integral with the supporting shaft for the thrust centrifugal unit, the result is that the two action-reaction units are exactly aligned whereby there are no frictional forces generated by lateral component forces due to possible axle misalignments.

The assembly comprising the supporting tube, the resilient stopping rings, springs and registering shims can easily be calibrated separately as an independent unit inserted in the governor assembly through the box hole left free by the supporting flange for the arbor. The insertion steps is thus particularly simple and quick.

It should be noted, moreover, that the unit supporting arbor prevents that the weight of the latter may insist upon the regulation levers.

In connection with the functional regulation characteristics which can be achieved with the resilient unit according to this invention, it can be noted that, by mounting a number of springs serially, linear or progressive, preloaded or not, supported by dishes which are floating or cooperate with resilient stop rings, it is possible to satisfy the most various regulation laws including those required by the present day Diesel engines for motor cars which are extremely sophisticated.

The functional and structural features of the invention and its advantages over the prior art will become still more apparent from the scrutiny of the exemplary description to follow referred to the accompanying drawings, wherein.

FIGS. from 3 to 14 inclusive are closeup views showing several possible different embodiments of the resilient unit with the relevant working diagrams.

Figures 1, 2:
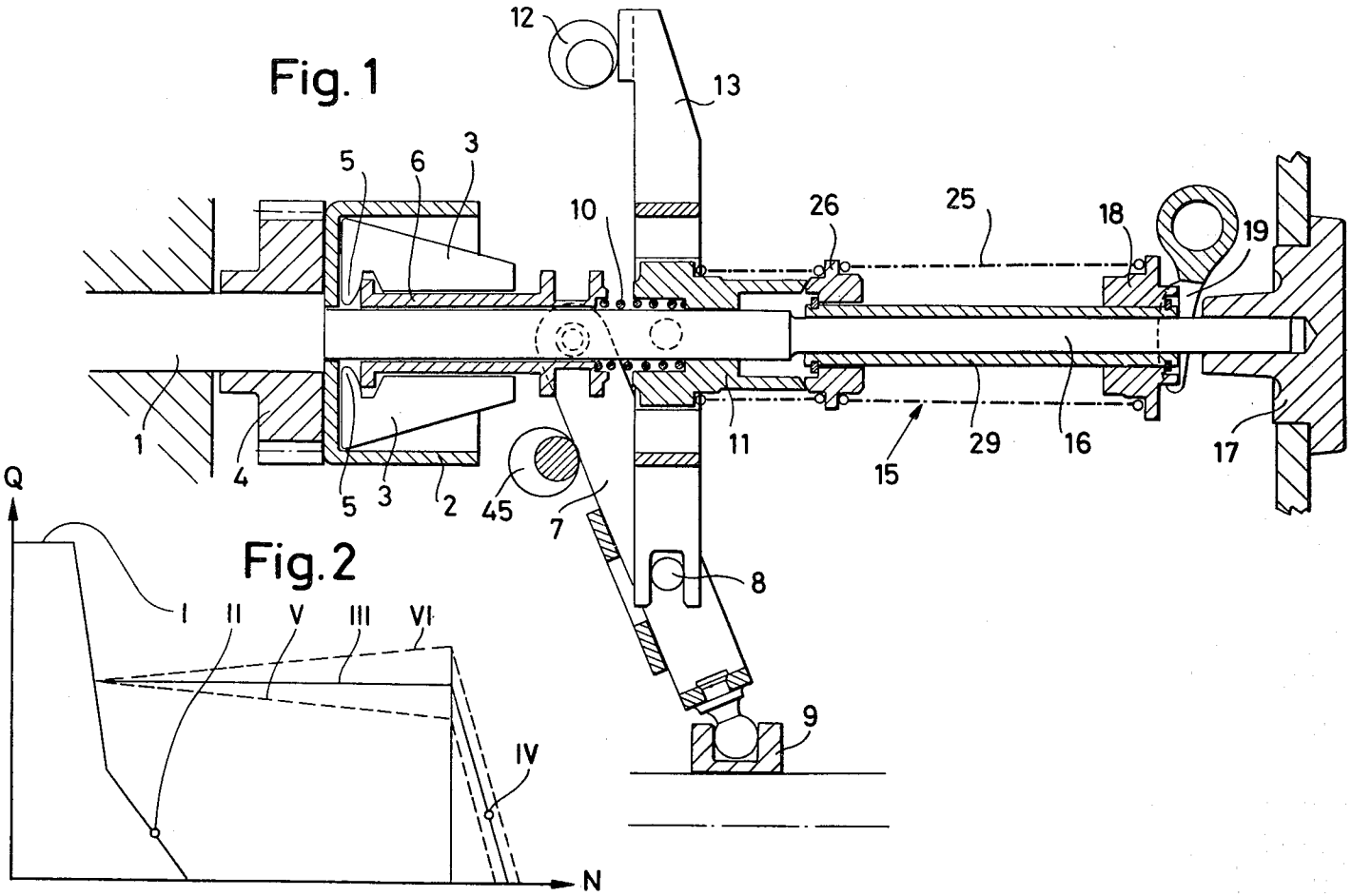
FIG. 1 shows a lengthwise fragmentary cross-sectional view of a centrifugal governor incorporating a resilient biassing unit according to the invention.
FIG. 2 is a working diagram of the governor according to FIG. 1.

FIGS. from 15 to 17 show different possible modifications to the structure of the governor shown in FIG. 1, and FIGS. 18 and 19 are detail views of the governor shown in FIG. 17.

FIG. 1 shows, partially, a centrifugal governor for injection pumps of the distributor type.

The arbor 1 supports the centrifugal assembly consisting of the cage 2 and the masses 3. This unit receives the drive from the gear 4 connected to the mainshaft of the injection pump (not shown). The rotation speed of the centrifugal unit is thus proportional to that of the pump so that it is also proportional to the rpm of the internal combustion engine fed by the pump concerned.

The centrifugal masses 3, urged to become swung open by said rotational speed, thrust, by their extensions 5, the sleeve 6 which is connected, via a roller coupling, to the regulation lever 7 pivoted to the pin 8. The lever 7 acts, with its other end, on the regulation ring 9 which causes, in a conventional manner, the determination of the quantity of fuel to be injected at every pump piston stroke. An optional eccentric 45 may limit the stroke of the lever 7 to a variable position. The thrust sleeve 6 is biassed, during a first shank of its stroke, by the additional spring 10. As soon as the speed of rotation of the centrifugal unit reaches, after starting, a value which corresponds to the idling rpm of the engine, the thrust generated by the masses 3 overcomes the bias of the spring 10 so that the sleeve 6 directly insist upon the slider 11. For an rpm from the idling upwards and thus all over the entire working range of the engine, the sleeve 6 and the slider 11 are virtually an entity.

The end position of the slider 11 towards the centrifugal unit is determined by the abutting eccentric 12 upon which, in said end position, the regulation lever 13 insists, which is pivoted to the slider 11 and cooperates with the pivot 8.

The unit biassing the thrust generated by the centrifugal forces of the masses 3 is composed of the idling spring 14 and the resilient unit 15 according to the present invention. The unit 15 in question can slide along the arbor 16, the latter being an integral extension of the governor shaft 1, supported by the end flange 17.

The end dish 18 of the resilient biassing unit 15 cooperates with the extension 19 of a drive-transfer lever which is conventionally linked to the governor control and thus to the accelerator pedal.

Figure 5:
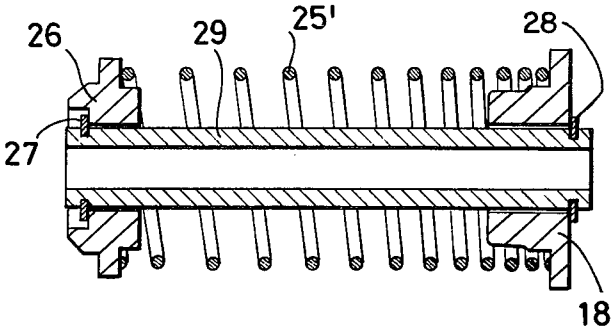
Figure 3:
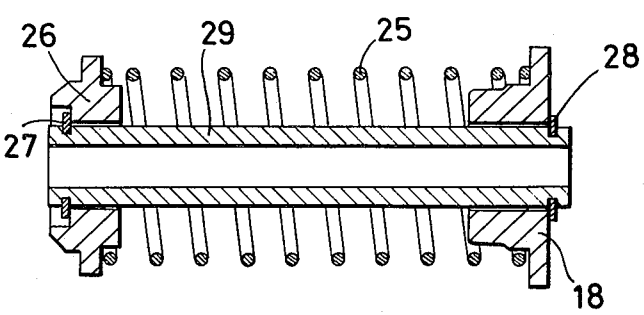

FIGS. 3, 5, 7 and 11 show embodiments of the biassing unit which are particularly suitable for centrifugal governors having a continuous-type operation. In FIG. 3, the single spring 25 is contained between the dish 26 (biassed by the resilient ring 27), and the dish 18 (cooperating with the stop ring 28). The assembly is supported by the tube 29 which is freely slidable, in operation, along the arbor 16 of the governor. In FIG. 5, the spring 25 (a linear compression spring) is replaced by a variable-pitch spring 25' which has a progressive stiffness.

Figure 7:
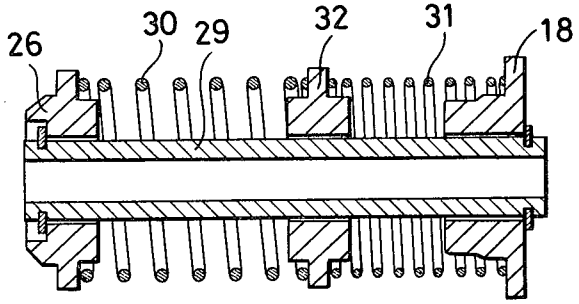

In the embodiment shown in FIG. 7 a certain gradual nature of operation is obtained by exploiting two springs, 30 and 31, having sharply different stiffness from one another, both springs cooperating with a dish 32 floatingly mounted on a tube 29.

Figure 9:
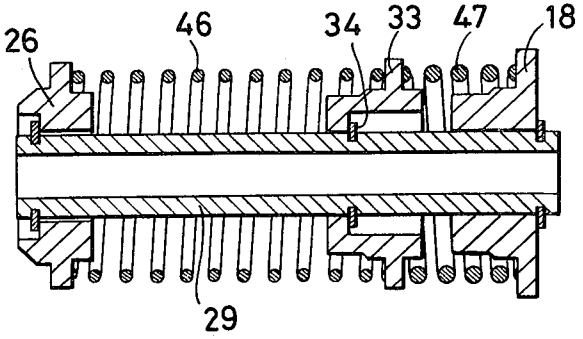

FIG. 9, instead, shows a resilient biassing unit which is particularly adapted to the centrifugal governors which work after the minimum-maximum principle. The springs are still two as in FIG. 7, but the central dish 33 permits, with the aid of the cooperating stop rings 34, to preload the two springs differently.

Figure 11:
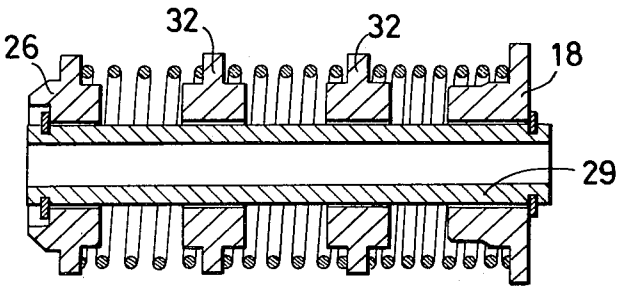

In the embodiment shown in FIG. 11, the same idea is adopted by fractionating the working range of the governor further by virtue of the adoption of three springs having different stiffness and two intermediate floating dishes.

Figure 13:
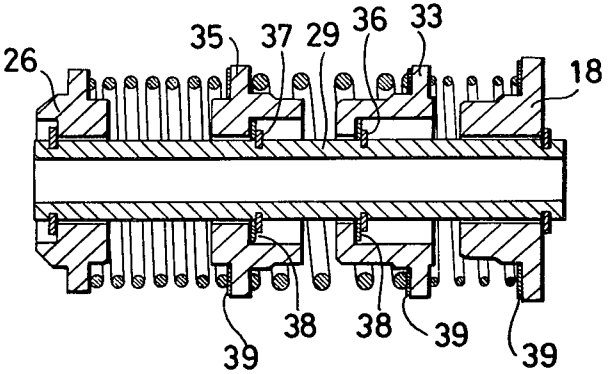

The embodiment shown in FIG. 13 permits, by virtue of the presence of the two central dishes 33 and 35 and the relevant stop rings 36 and 37, that rather intricate regulation laws may be obtained.

In FIG. 13, furthermore, there are shown the calibration shims for preloading the springs and the functional strokes. The same shims, even though not shown, are also used in the groups shown in the previously commented Figures of the drawings.

The internally mounted shims 38 influence both the spring preload and the functional strokes of the dishes, whereas the outer shims 39 act only on the preload of the attendant springs.

Figure 15:
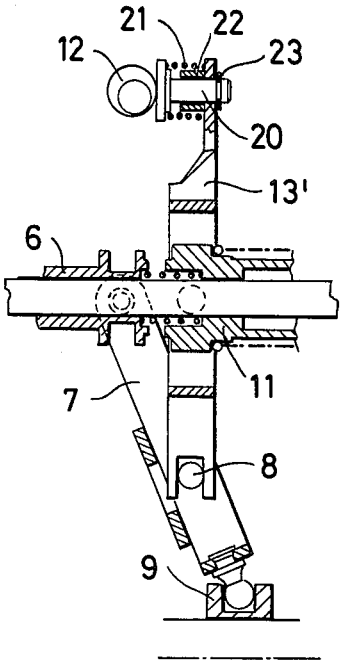

FIG. 15 shows a modification of the registration lever 13', which, instead urging against the regulation eccentric 12 by a fixed abutment tab, uses a resilient abutment sub-assembly consisting of the abutment pin 20, the equalizing spring 21, the thimble 22 and the resilient stop ring 23.

Figure 16:
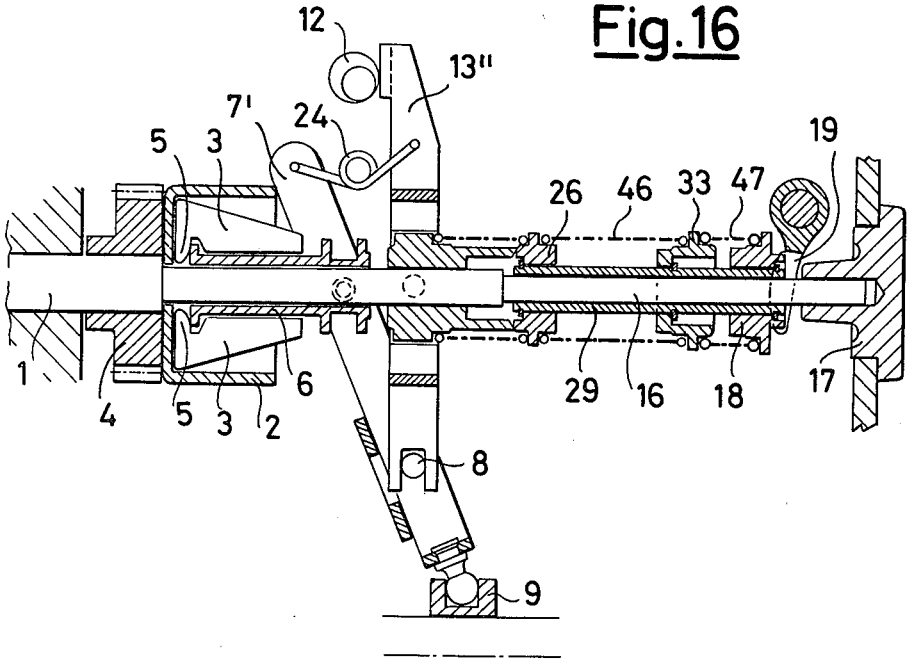

In FIG. 16, the function fulfilled in FIG. 1 by the additional spring 10 placed between the thrusting sleeve 6 and the slider 11, is, conversely, fulfilled by the scroll spring 24 which acts directly upon the levers 7' and 13''.

FIG. 17 shows a device for the equalization of the rate of flow which, contrary to that of FIG. 15, has a functional trend of the negative type. This device is preferably inserted directly on the movable section of the device and consists of a modified thrust sleeve 6', a sliding collar 40, a contact spring 41, the movable bushing 42, the resilient disc 43 and the slider 11' with its circular embossment 44.

The operation of the governor made according to the principles of this invention is as follows.

FIG. 1 shows the mechanism of the governor when the engine is at a standstill. The masses on which the bias of the supplementary spring 10 is applied, are closed and the sleeve 6 is thus in its position closest to the centrifugal sub-assembly. Under these conditions, the regulation lever 7, connected to the collar of the sleeve 6, shifts the regulation ring 9 in the position of maximum rate of flow. This rate of flow corresponds to the quantity of fuel which is required to start the engine (portion I of FIG. 2).

As the starting electric motor is energized, the engine can be started. Simultaneously, the thrust originated by the centrifugal masses 3 overcomes the bias of the spring 10 and the sleeve 6 goes to rest against the slider 11 so that the supplemental starting fuel feed is cut off.

If the position of the extension 19 of the linking lever (and thus of the accelerator pedal linked thereto) corresponds to that of idling operation, the biassing resilient sub-assembly is in its rearmost position relative to the centrifugal unit. Thus the slider 11 is subjected only to the reduced load of the idling operation spring 14 which biasses, even though it is in its rearmost position, the dish 26 of the resilient sub-assembly. Under these conditions, as the preselected idling rpm is attained, the regulation lever 13 no longer rests against the eccentric 12 and is brought, together with the slider 11, the sleeve 6, the regulation lever 7 and the ring 9, to an equilibrium position between the thrust of the masses 3 and the bias of the spring 14, corresponding to the rate of dispensing of the fuel for idling (point II of FIG. 2).

If, conversely, the linking lever and thus its extension 19 is brought to the high-speed position, the resilient biassing sub-assembly urges the slider 11 and, overcoming the urge of the masses 3, compels the lever 13, cooperating with the slider, to rest against the regulation eccentric 12.

Under these conditions the position taken by the thrust sleeve 6, which is virtually an entity with the slider 11, the lever 7 and the regulation ring 9, is that which corresponds to the fuel dispensing rate for the maximum torque (line III of FIG. 2). The adjustment of such a quantity of fuel can be made by shifting the regulation eccentric 12.

If the load conditions of the internal combustion engine, with the accelerator still in the position of highest speed, are such that its rpm exceeds a predetermined value (conditions N3 of the plots reported in FIGS. 4, 6, 8, 10, 12, 14) the thrust produced by the centrifugal masses overcomes the bias of the resilient sub-assembly and compels the entire movable section to be displaced, and not to insist any longer onto the eccentric 12 until such time as the reduced feed of fuel is consistent with the magnitude of the braking load applied to the engine. If no load conditions obtain, the new equilibrium conditions will be attained for a rate of dispensing of the fuel equal to the quantity which is required by the engine to be held running at high rpms (point IV of FIG. 2). The rpm which so corresponds, that is the maximum no-load rpm, will be the one indicated at N4 in the plots of FIGS. 4, 6, 8, 10, 12, 14.

The operation of the governor for positions of the outer control lever, and thus of the extension 19 of the linking lever, which are comprised between those of idling and maximum rpm, is a function of the structure of the biassing resilient sub-assembly.

Figure 4:
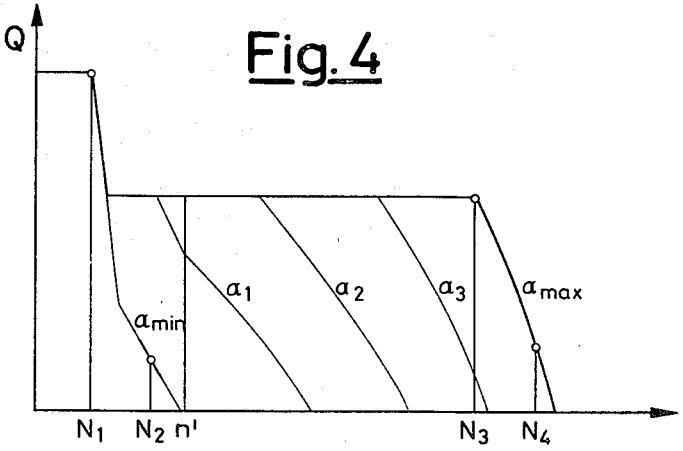

On the basis of the example shown in Figures from 3 to 14, it can be observed that:

FIGS. 3 and 4—The operation of the governor, also for intermediate positions of the control lever ($\alpha_1,\alpha_2,\alpha_3$) is of the continuous type. Inasmuch as the single spring is of the linear type, the operation curves become steeper as the rpm is increased.

Figure 6:
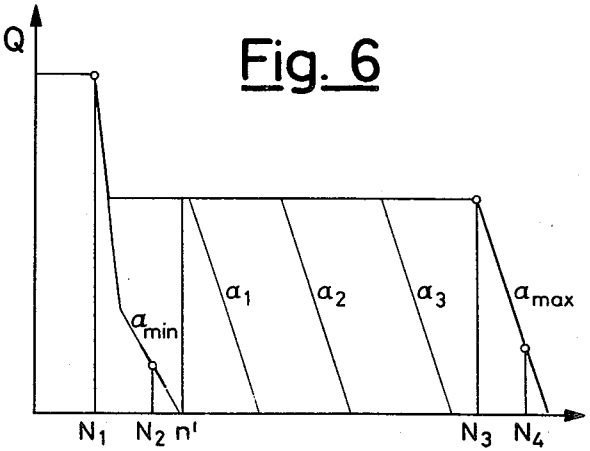

FIGS. 5 and 6—The operation of the governor is entirely similar to the previous one, but the progressive stiffness spring permits to keep constant the slope of the operation curves.

Figure 8:
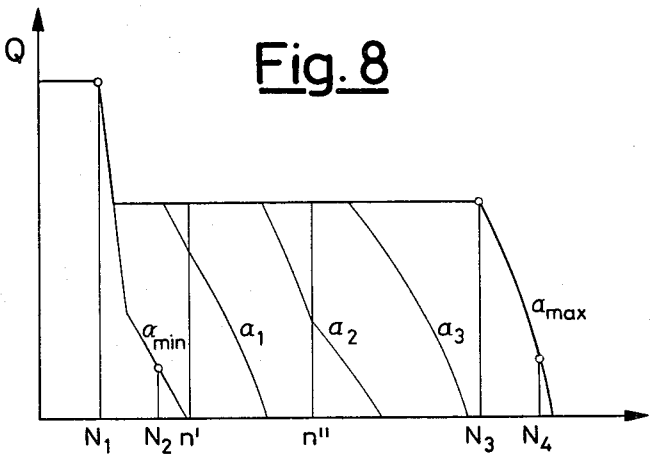

FIGS. 7 and 8—The operation of the governor is of the continuous type also in this case. The central floating dish permits, beyond a certain load magnitude, to exclude the more yieldable spring 31 as soon as the spring convolutions are in touch with each other or as soon as the central thimble 32 abuts the end thimble 18. The consequential increase of the stiffness of the assembly permits to prevent too steep a slope of the operation curves at the high rpms.

Figure 10:
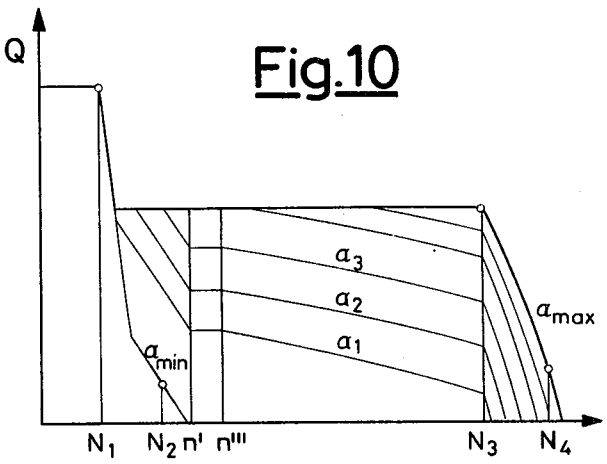

FIGS. 9 and 10—The resilient sub-assembly in this case is of the type which is adapted to minimum-maximum governors. The high rpm spring, 46, is mounted with a considerable preload between the thimble 33, resting against the stop ring 34 and the thimble 26. The thrust produced by the centrifugal masses attains the value of such preload at the rpm of maximum N3. The governor, once that rpm is overtaken, then begins to cut off the fuel feed.

For rpms below N3, it is appropriate to distinguish according to whether the resilient sub-assembly has an additional spring (as in the Figure concerned) or not.

If only the maximum-rpm spring is present (and in this case the sub-assembly would take the configuration of FIG. 3) in the range comprised between the rpm n′ corresponding to the end of the action of the idling rpm spring, and the rpm N3 at which the top-rpm spring enters action, any automatic operation of the governor would not take place. To every position of the external control lever, and thus of the extension 19 of the linking lever, there would correspond, irrespective of the rpm, a direct positioning of the entire movable section of the governor and of the spring 9 linked thereto. The trend of the delivery of the pump for partial inclination of the lever ($\alpha_1,\alpha_2,\alpha_3$) would consequently have, in the range between n′ and N3, the aspect of lines parallel to the line of maximum rate of flow.

It is sometimes desirable, however, that such a trend, for partial loads, may tend to decrease slightly as the rpm is increased. As a matter of fact, this is not properly an actual regulation, but, rather, an adaptation of the delivery curves to specific requirements of the user.

This function is automatically fulfilled by the second spring 47 housed between the thimbles 33 and 18.

The preload of spring 47 is such that, usually, the spring begins to be active at an rpm over the idling rpm (n‴ in the plot FIG. 10) and continues its action until the top rpm N3 is attained.

On account of the considerable stiffness of the spring 47, its effect on the delivery curves in the range from n‴ to N3 is restricted to a slight correction of them in the sense of reducing the rate of flow at the highest rpms (curves $\alpha_1,\alpha_2$ and $\alpha_3$ of FIG. 10).

Figure 12:
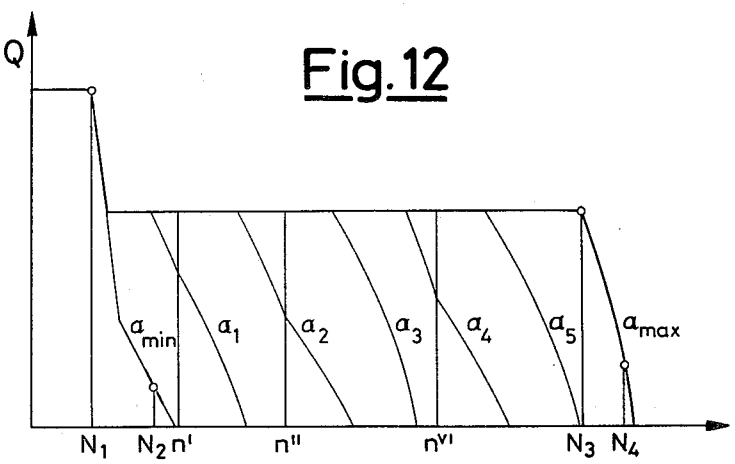

FIGS. 11 and 12—The operation of the governor is similar to that of FIG. 7 (continuous type). The segmentation of the functional range is however more intense due to the presence of three springs and two floating thimbles. The idea is still to exclude in sequential order a few springs to stiffen the assembly at the highest rpms.

Figure 14:
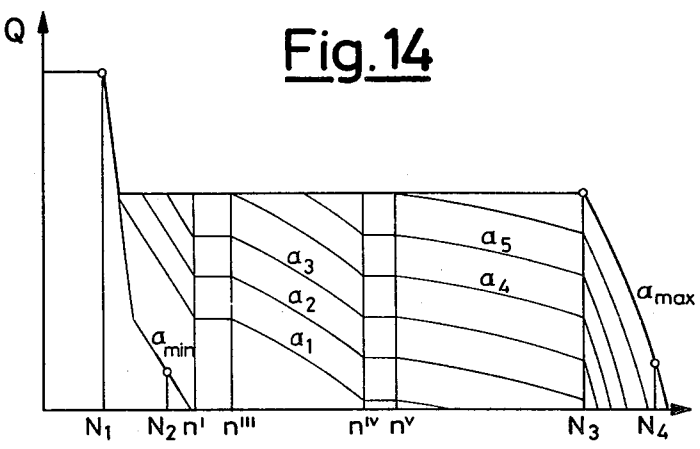

FIGS. 13 and 14—The basic concepts are those of FIG. 10 (minimum-maximum governor). The intermediate non-regulation range (n′ to N3) is served here by two equalizing springs having different stiffness which permit to obtain, within such a range, delivery curves having a differential trend.

What has been illustrated hereinbefore are but a few embodiments of resilient biassing sub-assemblies. By acting upon the preload, the number and the stiffness of the springs, as well as upon the active strokes of the guiding thimbles, the number of such examples can be amplified at leisure. It is fitting to note that the biassing sub-assemblies which produce a continuous-type operation for the governor (FIGS. 3, 5, 7, 11) find an elective application in marine engines and agricultural tractor engines, whereas those of the minimum-maximum type (FIGS. 9 and 13) are mostly indicated for motor car engines.

It is explained hereinafter that the rpm values given on the plots of FIGS. 4, 6, 8, 10, 12 and 14 represent:

$N_1$ = revolutions per minute at which cutoff of additional fuel is started
$N_2$ = revolutions per minute at idling
$N_3$ = Full load top rpm
$N_4$ = No load top rpm
n′ = End of stroke idling-rpm spring
n″ = End of stroke for the more yieldable spring
n‴ = Start stroke first delivery equalizing spring
$n'^{v}$ = End of stroke first delivery equalizing spring
$n^{v}$ = Start stroke second delivery equalizing spring
$n^{v\prime}$ = End of stroke intermediate stiffness spring In the operational diagrams of FIGS. 4, 6, 8, 10, 12 and 14, the law of variation of the delivery by the injection pump (Q in cubic mm per stroke) with the control lever of the governor in the maximum rpm position is represented as a straight line which is parallel to the abscissa axis (see also line III of FIG. 2). Even though in reality, the plot is different for hydrodynamic reasons, and actually it is sharply different, it is preferred to maintain such an assumption in order to illustrate in a clearer manner the operation of the equalizing devices shown in FIGS. 15 and 17.

In the two resilient biassing sub-assemblies having equalizers of the rate of flow for the intermediate rpms (FIGS. 9 and 13) it will be seen that such an equalization takes place for the delivery curves for which there is throttling, and not for the delivery curve corresponding to the maximum rate of delivery.

It may be requested, sometimes, that such an equalization takes place also, or exclusively, for the curve of the maximum rate of flow. If so, the governor according to the present invention provides for the possibility of inserting two modifications as a function of the kind of equalization which is desired.

As a matter of fact (plot of FIG. 2) the maximum delivery line III can provide a correction in the sense of decreasing the rate of flow at the high rpms (V), this being the commonest case, but also a correction for increasing the delivery as the rpm is increased (VI). The former is obtained by the device shown in FIG. 15, the latter with the device shown in FIG. 17.

For a correct understanding of the operation of the equalizer of FIG. 15 it is fitting to consider that, with the control lever of the governor, and thus with the extension 19 of the linking lever, in the position of maximum rpm, the preload applied by said extension 19 to the spring(s) of the continuously operating subassemblies, is discharged into the slider 11 so that, for the portion of the thrust of the centrifugal mass which is not balanced, onto the adjustable resting surface 12 of the lever 13. The reaction of this surface will thus be the lesser, the higher the pump rpm will be and will become nullified in the vicinity of the maximum rpm at which the governor enters action.

By replacing the stiff resting tab of lever 13 on the eccentric 12 a yielding resilient device, the lever 13' (FIG. 15) will effect, as contrasted by the spring 21 having a considerable stiffness, slight displacements as a function of the resting load on the eccentric which adjusts the rate of flow. Similar and slight displacements will be carried out, proportionally to the different lever arm, by the slider 11, the thrust sleeve 6 cooperating therewith and, consequently, by the lever 7 and the adjusting ring 9 with a consequential modification of the dispensed fuel.

Inasmuch as, as outlined above, the force by which the lever 13' thrusts on the eccentric 12, when the control lever of the governor is in the maximum rpm position, will become minimized for the highest rpms and maximized at the lowest rpms, so that a decrease of the rpm originates an increase of the force transferred by the small spring 21 and thus a slight release of the latter with an attendant displacements of the entire movable section towards the centrifugal unit. This fact implies, by a corresponding displacement of the regulating ring 9, an increase of the amount of fuel injected at every stroke of the pumping member.

By varying the stiffness and the preload of the equalizing spring 21 as well as the length of the spacing tube 22, it is possible to obtain any desired value of correction of the natural delivery curve of the injection pump.

This kind of equalization (increase of the delivery concurrent with the decrease of the rpm) is shown by the line V of the plot of FIG. 2 and is called "positive". A "negative" equalization of the maximum rate of flow (increase of the delivery as the rpm is increased) can be obtained, conversely, with the device shown in FIG. 17.

Such an equalization exploits directly the thrust resulting from the centrifugal unit and thus, contrarily to the type of positive equalization disclosed in the foregoing, always present independently of the position of the control lever of the governor. The result is that not only the maximum delivery line takes a trend as shown at VI in the plot of FIG. 2, but also the fractional delivery curves will take trends parallel to said line.

The "negative-type" equalization is obtained by interposing between the slider 11' (FIG. 17) and the thrust bushing 42 housed therein, a resilient disc 43 of the star type. The sleeve 6', by pressing with a thrust deriving from the centrifugal unit onto the bushing 42, originates a deformation of the leaf disc which, by pivotally acting on the annular extension 44 of the slider 11', originates, the position of the lever 13 remaining the same, an advance of the collar 40, slidable on the sleeve 6, towards the centrifugal unit.

To said collar, maintained in contact with the outer portion of the resilient blade 43 by the recoil spring 41, is directly connected the lever 7 which transfers the drive to the regulation ring 9. By varying, as a function of the rpm, the thrust of the governor, the deformation of the disc will proportionally be varied and, thus, the position of the collar 40 with a consequential influence on the injection pump. The position of said collar will be the closer to the centrifugal unit, the greater the thrust will be and thus the greater the rpm will be.

Inasmuch as the delivery of the pump is directly proportional to the closeness of the roller pin of the lever 7, cooperating with the collar 40, to the centrifugal unit, the result will be that at the high rpms (heavy thrust) the delivery will be greater than that given at the low rpms.

In FIGS. 18 and 19 there are shown two among the various possible embodiments of the resilient blade 43. The eccentric 45 shown in FIG. 1 serves to adjust from the outside the superdelivery stroke. The eccentric 45, supported by the governor box, can, in fact, limit, as the pump is stopped, the backward movement of the sleeve 6 thrust by the ancillary spring 10, towards the centrifugal unit.

The adjustment of the eccentric and thus of the amount of fuel which is desired for the additional supply at the engine start, will be carried out in the pump calibration stage.

It is desirable, however, and frequently, that the supplemental delivery of fuel at the start is not always constant but that it may tend to be varied as a function of the engine temperature.

In the starting operation with a hot engine, in fact, it is useless and detrimental to leave inserted the considerable superdelivery which is required for starting a cold engine.

In the case of such a requirement, the eccentric pin of 45, or of a corresponding cam having any shape, can be connected to an external lever (not shown) which, resting against an abutment which is movable as a function of the engine temperature varies the position of the eccentric and consequently the fuel-supplementing stroke. The same device, consisting of an eccentric and an external lever, can also fulfil the function of manual engine stopping. If so, it is sufficient to bring the external lever in such a position that the eccentric or cam 45 compels the lever 7, connected to the regulation ring 9, to exclude not only the supplementary delivery but also the normal delivery of the pump.

We claim:

1. In a centrifugal governor for injection pumps adapted to feed internal combustion engines including an arbor having slidably mounted thereon means for regulating the quantity of fuel to be injected, centrifugal means responsive to engine speed for operating said regulating means, means responsive to sliding movement of said regulating means in a first direction for governing the speed of an associated internal combustion engine, the improvement comprising a resilient biasing unit housed upon said arbor in sliding relationship thereto between said regulating means and said speed governing means, said resilient biasing unit including a tube in external telescopic relationship to said arbor, a pair of seats mounted for relative sliding movement upon said tube and relative to each other, at least one spring between and biasing said seats away from each other, stop means at opposite ends of said tube for limiting the movement of the seats away from each other, and said regulating means and governing means being operatively coupled each to one of said seats whereby upon movement of said regulating means in said first direction, said movement is transferred through a first of said seats, said spring and a second of said seats to said governing means.

2. The improvement in a centrifugal governor for injection pumps as defined in claim 1 including a third seat and at least a second spring, said third seat being located between said pair of seats, said one spring being located between one of said pair of seats and said third seat, and said second spring being located between another of said pair of seats and said third seat.

3. The improvement in a centrifugal governor for injection pumps as defined in claim 1 including a third seat and at least a second spring, said third seat being located between said pair of seats, said one spring being located between one of said pair of seats and said third seat, said second spring being located between another of said pair of seats and said third seat, and said third seat being freely slidable along said tube.

4. The improvement in a centrifugal governor for injection pumps as defined in claim 1 including a third seat and at least a second spring, said third seat being located between said pair of seats, said one spring being located between one of said pair of seats and said third seat, said second spring being located between another of said pair of seats and said third seat, and means for resiliently securing said third seat to said tube.

5. The improvement in a centrifugal governor for injection pumps as defined in claim 1 wherein said stop means are resilient.

6. The improvement in a centrifugal governor for injection pumps as defined in claim 1 wherein said seats are annular members and said stop means are formed by an annular stop ring seated in an associated groove of said tube.

7. The improvement in a centrifugal governor for injection pumps as defined in claim 1 including means for biasingly urging said regulating means away from and in spaced relationship to said first seat at speeds up to idling speed of an associated engine, and said centrifugal means being operative beyond idling speed to override said biasing means and move said regulating means into unbiased operative engagement with said first seat.

8. The improvement in a centrifugal governor for injection pumps as defined in claim 1 including first and second biasing means between which is housed said regulating means, said first biasing means being operative for biasingly urging said regulating means away from and in spaced relationship to said first seat at speeds up to idling speed of an associated engine, a second sleeve between said centrifugal means and said second biasing means, said second biasing means being operative for biasingly holding said sleeve out of engagement with said regulating means at speeds up to idling speed of an associated engine, and said centrifugal means being operative beyond idling speed to override said first and second biasing means and establish unbiased operative engagement between said second sleeve, regulating means and first seat.

9. The improvement in a centrifugal govenor for injection pumps as defined in claim 2 wherein said one and second springs are of different stiffnesses.

10. The improvement in a centrifugal govenor for injection pumps as defined in claim 2 wherein said one and second springs establish unequal biasing forces.

11. The improvement in a centrifugal govenor for injection pumps as defined in claim 2 including means for limiting the movement of said third seat toward at least one of said pair of seats.

* * * * *